US007987863B2

(12) United States Patent
Warner

(10) Patent No.: US 7,987,863 B2
(45) Date of Patent: Aug. 2, 2011

(54) MODULAR POLE TENT AND JOINING MEANS

(75) Inventor: Gery Warner, Vancouver (CA)

(73) Assignee: Tentnology Limited, Hamilton (BM)

( * ) Notice: Subject to any disclaimer, the term of this patent is extended or adjusted under 35 U.S.C. 154(b) by 832 days.

(21) Appl. No.: 11/162,760

(22) Filed: Sep. 21, 2005

(65) Prior Publication Data

US 2007/0062567 A1 Mar. 22, 2007

(51) Int. Cl.
*E04H 15/18* (2006.01)
*E04H 15/64* (2006.01)

(52) U.S. Cl. ..... 135/97; 135/115; 135/119; 52/222; 52/83; 160/395

(58) Field of Classification Search ..... 135/95–97, 135/121, 124, 115, 119, 906, 907, 908; 52/83, 52/222, 2.19, 2.22, 2.24; 24/580.1; 160/392, 160/395

See application file for complete search history.

(56) References Cited

U.S. PATENT DOCUMENTS

| | | | | | |
|---|---|---|---|---|---|
| 2,388,297 | A | * | 11/1945 | Slaughter | 428/53 |
| 2,923,305 | A | * | 2/1960 | Cline | 52/2.23 |
| 2,986,150 | A | * | 5/1961 | Torian | 52/63 |
| 3,744,191 | A | * | 7/1973 | Bird | 52/2.23 |
| 3,811,454 | A | * | 5/1974 | Huddle | 135/124 |
| 3,875,623 | A | * | 4/1975 | Johnston | 24/580.1 |
| 4,034,772 | A | * | 7/1977 | Huddle | 135/119 |
| 4,201,359 | A | * | 5/1980 | Baslow | 248/345.1 |
| 4,452,294 | A | * | 6/1984 | Fukuchi | 160/395 |
| 4,817,655 | A | * | 4/1989 | Brooks | 135/121 |
| 4,878,322 | A | * | 11/1989 | Ikeda et al. | 52/2.18 |
| 4,942,895 | A | * | 7/1990 | Lynch | 135/99 |
| 4,976,074 | A | * | 12/1990 | Delamare | 52/2.23 |
| 5,080,423 | A | * | 1/1992 | Merlot et al. | 296/105 |
| 5,234,011 | A | * | 8/1993 | Lynch | 135/99 |
| 5,477,876 | A | * | 12/1995 | Moss | 135/97 |
| 5,526,610 | A | * | 6/1996 | Delamare | 52/2.24 |
| 5,613,543 | A | * | 3/1997 | Walton | 160/265 |
| 5,784,842 | A | * | 7/1998 | Wackerbauer | 52/222 |
| 5,829,820 | A | * | 11/1998 | Cowsert | 296/107.11 |
| 5,953,875 | A | * | 9/1999 | Harkins | 52/407.3 |
| 6,345,638 | B1 | * | 2/2002 | Warner | 135/123 |
| 6,474,022 | B1 | * | 11/2002 | Double et al. | 52/3 |
| 6,502,593 | B1 | | 1/2003 | Stafford | |
| 6,530,165 | B2 | | 3/2003 | Griesemer et al. | |
| 6,564,513 | B2 | * | 5/2003 | Henbid et al. | 52/86 |
| 6,832,571 | B2 | * | 12/2004 | Eagles | 114/256 |

FOREIGN PATENT DOCUMENTS

| | | | |
|---|---|---|---|
| CH | 635393 | A5 * | 3/1983 |
| DE | 3824142 | A1 * | 1/1990 |
| EP | 7580 | A1 * | 2/1980 |
| GB | 2359312 | A * | 8/2001 |

OTHER PUBLICATIONS

An English translation for document EP 007580 A1 to Feilhauer (pp. 1-4).*

* cited by examiner

*Primary Examiner* — Winnie Yip
(74) *Attorney, Agent, or Firm* — Vermette & Co.

(57) ABSTRACT

A tensile pole tent having improved wind performance, having a polygonal projection in plan view, perimeter catenaries, a flexible canopy continuously attached to the catenaries, corner posts to support the catenaries, a membrane interface or field joint between adjacent membrane modules consisting of, for example, a novel water-shedding keder rail, or a zipper or daisy chain grommets and loops. The membrane interface can be sealed against precipitation by cover flaps that extend upwards from the membrane and come into contact above the interface.

7 Claims, 8 Drawing Sheets

MODULAR POLE TENT AND JOINING MEANS

FIELD

The present invention relates to a low-profile, polygonal, pole-supported tent whose modular bays are joined by a water-shedding keder rail and wherein joints between bays are sealed against water by flaps adjacent the edges of the bays.

BACKGROUND

Conventional tensile structures and tents that span large areas must be fabricated in modules to facilitate transport and handling. Modularization of the membrane presents challenges for joining it into one weather-proof membrane. Field joints are generally labour intensive, prone to leaking, and often unsightly. Field joint covers made to weatherproof lace line and other joints often employ hook and loop fasteners (i.e. Velcro) or snap, hook, and cable fasteners which are extremely sensitive to accurate indexing and almost always set up conditions for shear forces to present wrinkles along the seam cover material. Fabric joints on frame tents are made at the beams and are often prone to leaking water. However, such beams are not used in a pole supported tent, necessitating beam-free joints.

A keder, or keder strip, is a thickened edge on a membrane such as a sail, tent canopy, etc., which, when inserted into an extrusion made to accommodate it, (e.g. a keder extrusion, keder beam or keder rail) serves to fix the membrane to the extrusion. The keder extrusion has at least one channel, having a narrowed elongated opening, that receives the keder. Since the width of the keder is greater than that of the elongated opening, the only way it can be inserted or removed is to slide the keder along the channel and out one of the ends. The keder beam, rail or extrusion made to hold the keder can be made from any one of a variety of materials, but lately extrusions are considered to be the favored option.

The use of keder extrusions to join tent membranes is known in the art. However, their use is limited because they are prone to leaking. This makes keder extrusion particularly unsuitable for joining tent canopy modules at low points of a tent canopy. For this reason keders are not used to join membranes in canopy "valleys".

As well, the height of a pole tent is dictated by the minimum slope acceptable to ensure proper drainage. The minimum slope is found on the fall line at the corners of rectangular tents. The wider the tent, the higher the peak(s) required to maintain the minimum acceptable corner slope. Higher peaks require longer poles and/or beams, adding to the weight, size and cost of the tent. It also means that the tent is more vulnerable to wind, therefore requiring more anchorage, thereby further increasing the weight, size and cost of the tent.

Accordingly, it is an object of the present invention to provide a tent structure with an effective membrane joining system that is easy to manufacture and erect. It is a further object to provide a tent with low wind profile. It is a further object of this invention to provide a tent with excellent water shedding and drainage characteristics. It is a further object to provide a tent with fabric tensioned to the level of permanent tensile structures without the complex mechanical devices and means to erect it, but instead with a simple mechanical means to introduce said tension in a safe manner by only one person. It is a further object of this invention to provide a tent with minimal ground anchorage and maximum span between side posts.

SUMMARY OF THE INVENTION

According to the invention a tensile pole tent, having two centre poles and a polygonal projection in plan view, is provided, having a flexible membrane canopy with perimeter catenaries, and corner posts (perimeter columns) to support the perimeter catenaries. The membrane is made up of two modules, each supported by a centre pole, and each having a long edge. The long edges of the modules are joined to one another along a membrane interface or field joint consisting of, for example, a novel water-shedding keder rail, or a zipper or daisy chain grommets and loops. The membrane interface can be sealed against precipitation by cover flaps that extend upwards from the membrane.

The interface bisects the tent in between the centre poles.

The membrane interface or field joint is provided by one of several means, for example:

- a grommet and loop known as "daisy chain";
- a structural zipper; and
- a keder rail joining opposing keder strips welded to the edges of adjacent membrane modules (the keder rail is shaped to shed water to minimize butt joint leakage).

Although the keder rail is described in this application in the context of a tensile pole tent structure, it will be readily apparent to persons skilled in the art that it has numerous additional applications and that it is not limited to tensile pole tents. The keder rail is essentially a means for providing a leak-proof joint between adjacent membranes or sheets and, therefore, is applicable to a wide variety of tents, including frame tents, tensile structures, awnings, canopies, etc. The keder rail may also be used in permanent membrane structures.

Each one of the above field joint means (zipper, grommet and loop, Velcro, keder rail or extrusion) can be sealed with a pair of cover flaps symmetrical to the centre line of the field joint. The seam seal works by engaging the tension in the membrane itself to press the opposing flaps together in an abutting "prayer" position, thereby covering the field joint and shielding it from exposure to the elements. Because the flaps are not connected to their opposite member (i.e. they are in contact but not actually joined) they are able to slide against one another. Therefore, no shear forces transmitted between adjacent membrane modules and therefore there are no wrinkles in the membrane or the flaps. So the seal is smooth and attractive, unlike prior art seals (e.g. Velcro flaps).

Employing a heavy weight fabric strip further enhances the pressure between the two strips. The flaps may be made of any suitable material, including plastic, PVC, rubber, etc. Employing a PVDF or Teflon finish on the inner surfaces of the flap helps to guard against capillary action.

The novel keder rail and the "prayer" cover flaps of the present invention permit adjacent tent membrane modules to slide relative to one another and therefore do not transmit shear forces. This contributes to a wrinkle-free tent membrane.

The novel keder rail and the "prayer" cover flaps of the present invention additionally provide a water tight interface between adjacent membrane modules. This makes it possible to join the tent modules in the valleys, or low points of the membrane, rather than at the pole tops and ridges as in the prior art (i.e. where field joints are limited to relative high regions of the membrane). By joining tent modules at the pole tops and ridges, the cost of manufacture of the tent is increased because of the extra terminations at both the side and centre poles.

Furthermore, the novel keder rail and the "prayer" cover flaps make field assembly much quicker as joining modules requires no more lacing, and the need to Velcro or snap sealing flaps down over the membrane joints is eliminated. This is very important in portable structures since installation and take down may be repeated hundreds of times during a tent's lifetime.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
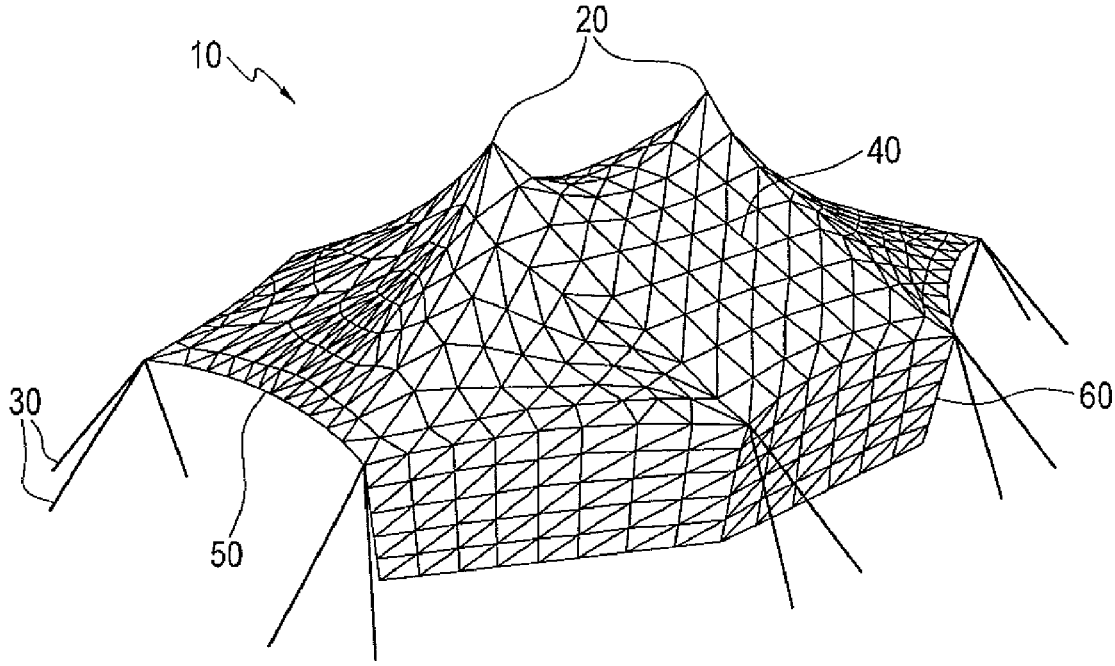
FIG. 1 is a perspective view of an assembled tent.
Figure 2A:
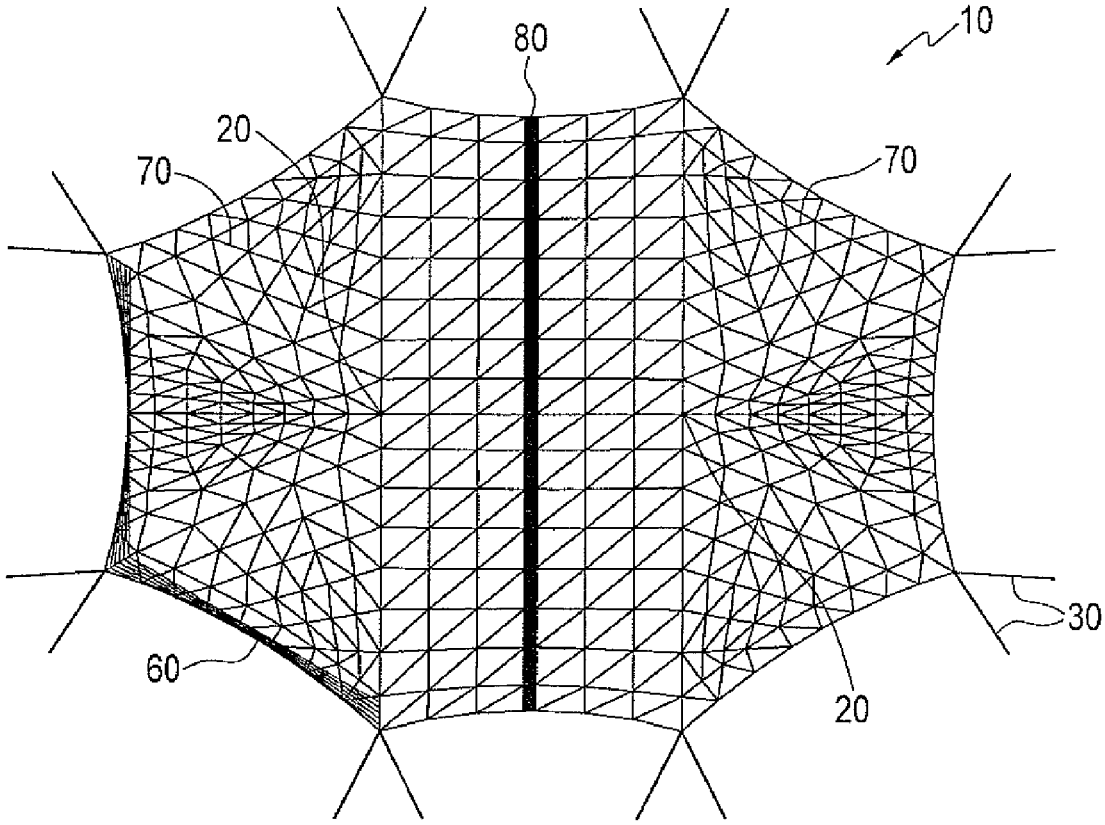
FIGS. 2(*a-d*) are plan, perspective and side views of an assembled tent.
Figure 2B:
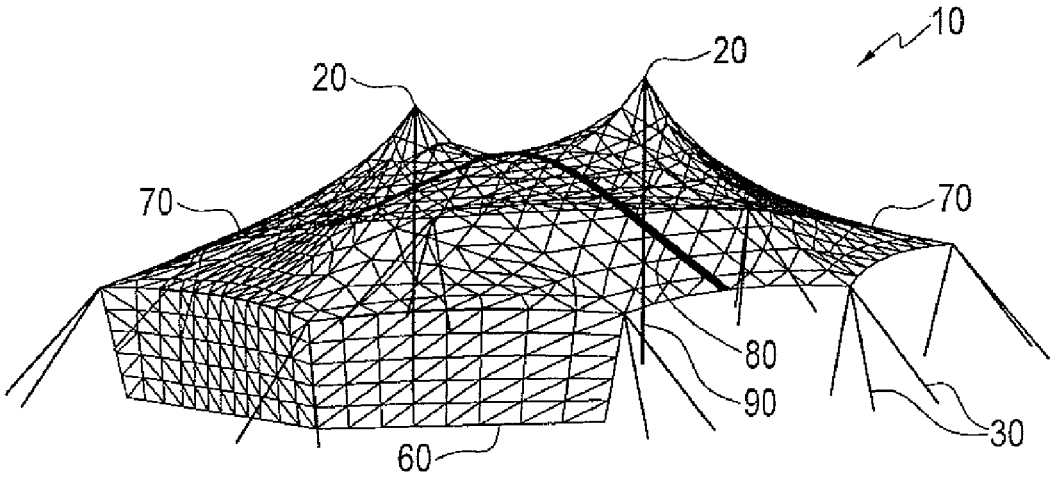
Figure 2C:
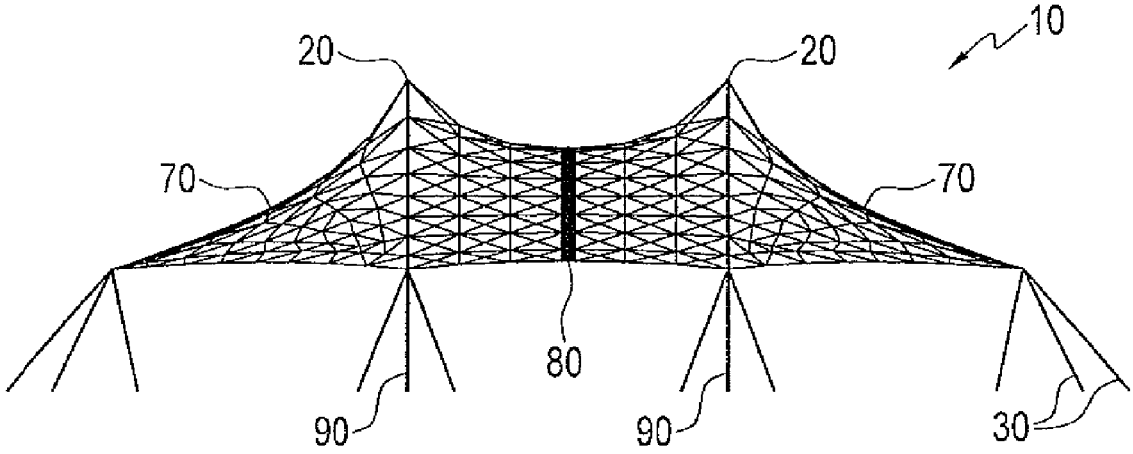
Figure 2D:
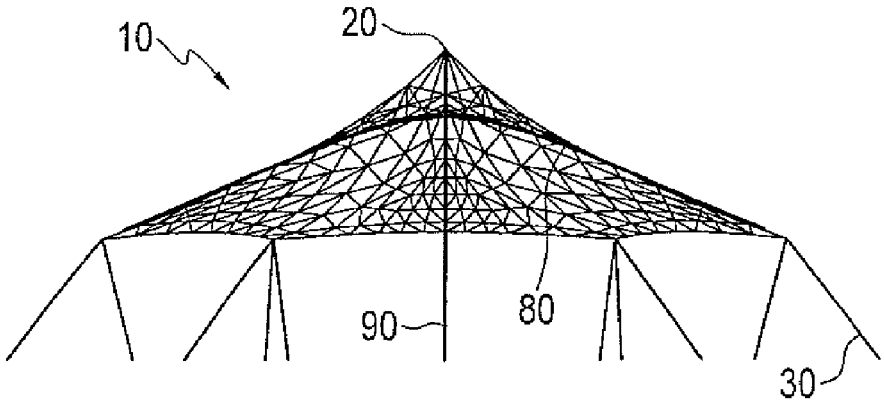

Referring to FIG. 1, a pole tent 10 is shown, having peaks 20 and anchor lines 30. The flexible membrane 40 of the tent has perimeter catenaries 50. Tent wall 60 may be removed and/or repositioned to another side of the tent 10 (see, for example, FIGS. 2(*a*) and 2(*b*)).

Referring to FIGS. 2(*a-d*) and 12, the membrane 40 of the tent 10 is made up of two modules, or bays, 70. The modules 70 are joined to one another along an interface or field joint 80, the details of which will be described more fully below. The interface 80 passes through a valley, (i.e. low point) of the membrane 40. The tent 10 has two centre poles 90, each supporting a respective one of the peaks 20, and eight corner posts 100 supporting the perimeter catenaries 50 at ends thereof. The membrane 40, the perimeter catenaries 50, and the interface 80 are tensioned by the anchor lines 30, producing a tensile structure. The tent 10 has no beams.

The distance from the peak or centre pole of a tent to the furthest boundary (i.e. corner) on a square or rectangle is farther than it would be on a polygon having more than four corners (assuming the comparison is between two tents covering an equal area when viewed from directly above). This is because in hexagons, octagons and other polygonal tents having more than four corners, the corners are in essence "truncated." Since the slope of the membrane decreases exponentially with distance from the peak or centre pole in tensile tent structures, the drainage is better on truncated shapes than on 90 degree corners (i.e. the distance from peak to corner is reduced, thereby resulting in a steeper membrane slope near the corners). Consequently, by employing truncated shapes such as octagons or hexagons, the centre pole(s) and peak(s) may be lowered. The advantages of this are legion: ease of erection of a much shorter centre pole, lighter weight, smaller section modulus, lower cost of the centre pole(s); less fabric employed in the manufacture the tent; less membrane weight to lift during erection; lower membrane cost; wider modules or bays possible with improved drainage, reduced wind profile, resulting in better weather performance and making possible the use of lighter materials, fewer anchors, less hardware and fewer side support poles, with attendant lower costs and improved ease of assembly.

The distance from the peak or centre pole of a tent to the corner can also be reduced by using more than one centre pole. Accordingly, the illustrative embodiment of FIGS. 1 and 2 employ two centre poles, thereby simultaneously achieving a lower wind profile and improved drainage. It will be readily apparent to persons skilled in the art that more than two centre poles may be used, however, the more poles will affect lines of sight and freedom of movement under the tent. Therefore, it will be up to the end user in each case to determine how many centre poles (e.g. 2, 3, 4 . . . ) will be appropriate for their circumstances.

As will become apparent in the description below, the novel leak-resistant membrane interface 80 of the present invention makes it possible to join membrane modules at a low point of the membrane, essentially bisecting the tent between the centre poles. This makes it possible to design a low-wind profile tent without many of the disadvantages of the prior art (i.e. complex and expensive membrane construction, difficult and labor intensive set-up and take-down, aesthetically compromised membrane, etc.).

Figure 3:
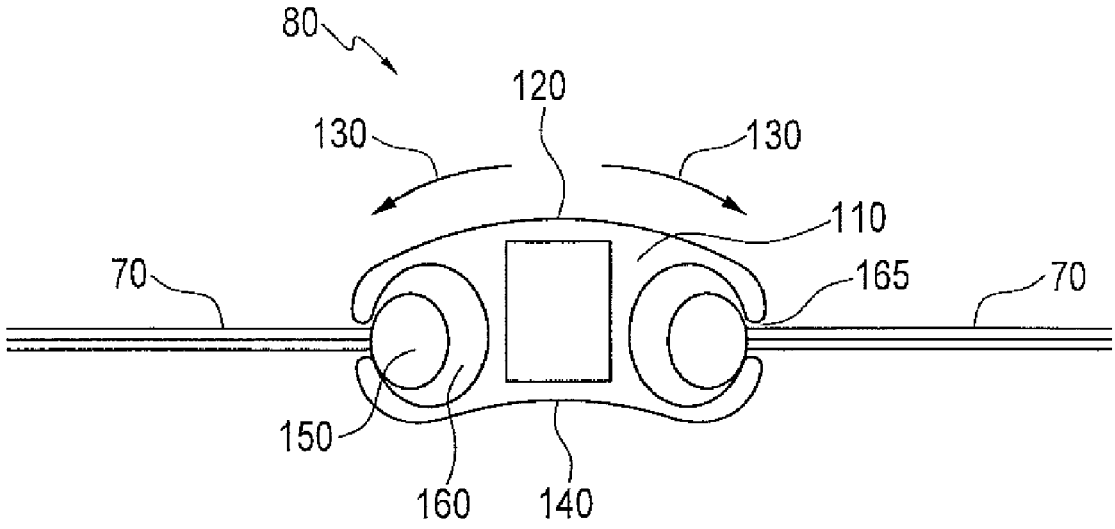
FIG. 3 is a sectional view of a field joint using a keder rail.
Figure 4:
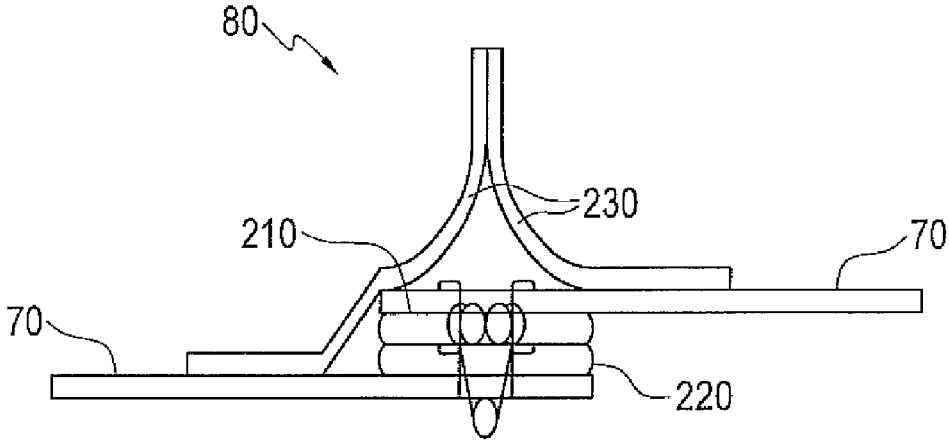
FIG. 4 is a sectional view of a closed eyelet and lace field joint with a cover flap seal.
Figure 5:
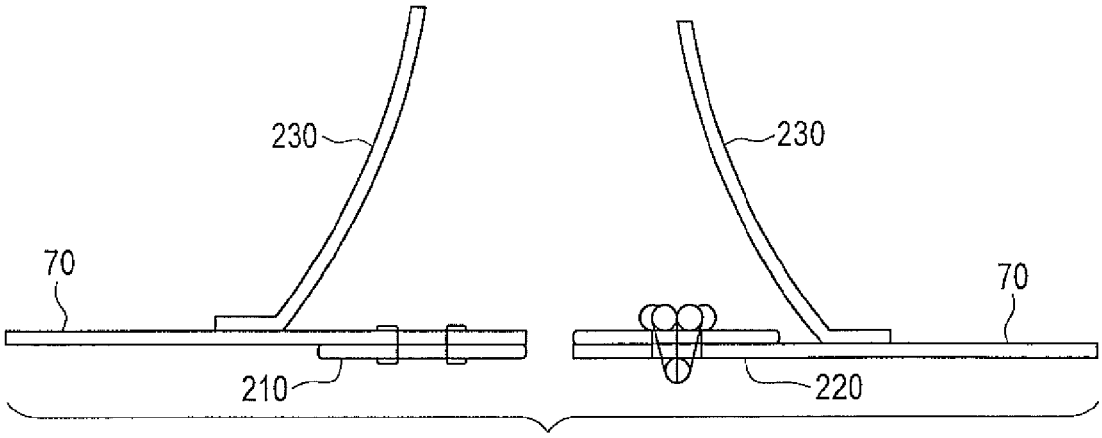
FIG. 5 is a sectional view of an open eyelet and lace field joint with a cover flap seal.
Figure 6:
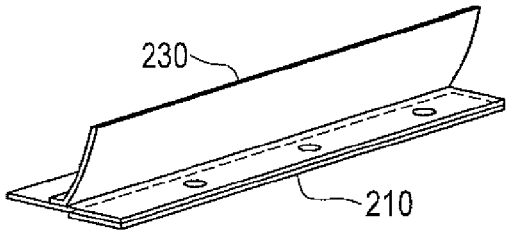
FIG. 6 is a perspective view of the eyelet side of a membrane field joint with cover flap.
Figure 7:
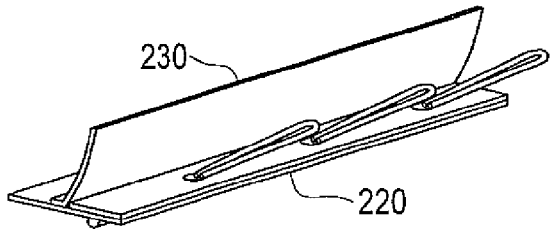
FIG. 7 is a perspective view of the lace side of a membrane field joint with cover flap.
Figure 8:
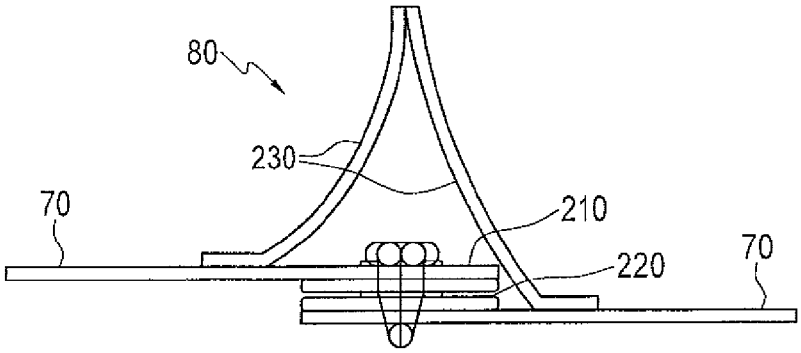
FIG. 8 is a sectional view of a closed field joint with cover flap seal.

FIG. 3 shows one embodiment of the field joint 80. A novel keder rail 110 is shown in cross-section, joining adjacent modules 70 of the tent canopy membrane. The keder rail 110 has a channel on each side, each channel having an internal cavity 160 and an elongated opening 165. The channel receives a keder strip 150 at the edge of the membrane module 70. The keder rail 110 has a convex surface 120 on its upper side, so that water (i.e. rain water) is shed in the direction of arrows 130. The lower side 140 of the keder rail 110 is shown to be concave in the present embodiment, however, it may be either flat, convex, or concave. By shedding water to the sides, water is prevented from leaking through the butt joints between adjacent keder rails 110 and into the tent 10. Once water is flows off of the keder rail 110 and onto the surface of the membrane 40 it will run with gravity along the surface of the membrane toward the edge of the tent 10.

In the preferred embodiment, the keder rail 110 is flexible such that it can conform to the curvature of the tent membrane. However, in other applications, the keder rail 110 may be rigid (e.g. when it forms a part of a structure, for example, a beam).

Prior art keder extrusions are flat-surfaced. This means that a water droplet running down the fall line on the upper surface of the keder extrusion eventually encounters a joint between adjacent keder extrusions. The droplets run into the crack between adjacent keder extrusions and leak into the tent. By curving the upper surface 120 of the keder rail 110, water droplets following the fall line run off to the side of the keder rail. The only water that will intrude through the joint between adjacent keder rails is that which falls upon a small, approximately triangular region immediately above the joint.

Figure 13:
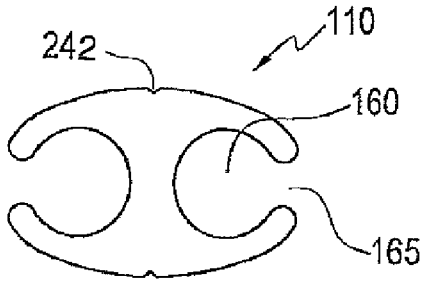
FIG. 13 is a sectional view of an alternate embodiment of the keder rail.
Figure 14:
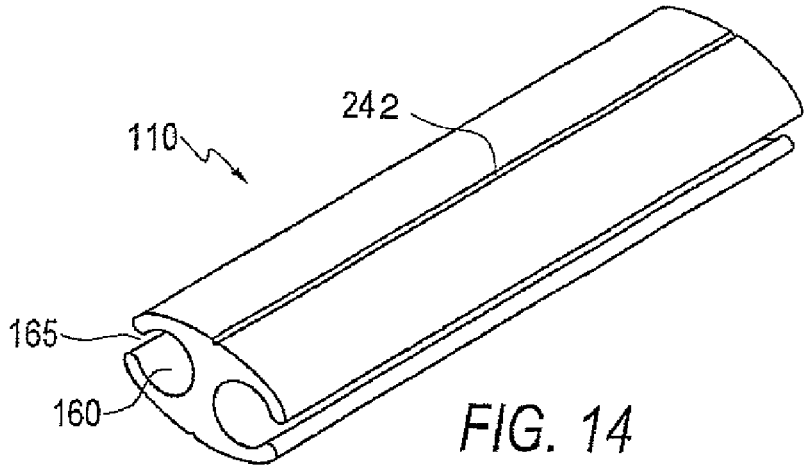
FIG. 14 is a perspective view of the an alternate embodiment of the keder rail.

Referring to FIGS. 13 and 14, a symmetrical alternate embodiment of the keder rail 110 is shown having convex surfaces on both sides. Obviously, whichever convex surface happens to be the upper surface will act to shed water to the sides of the keder rail 110. As with the previous embodiment, the keder rail embodiment of FIGS. 13 and 14 has elongated channels, each having an internal cavity 160 and an elongated opening 165.

Figure 15:
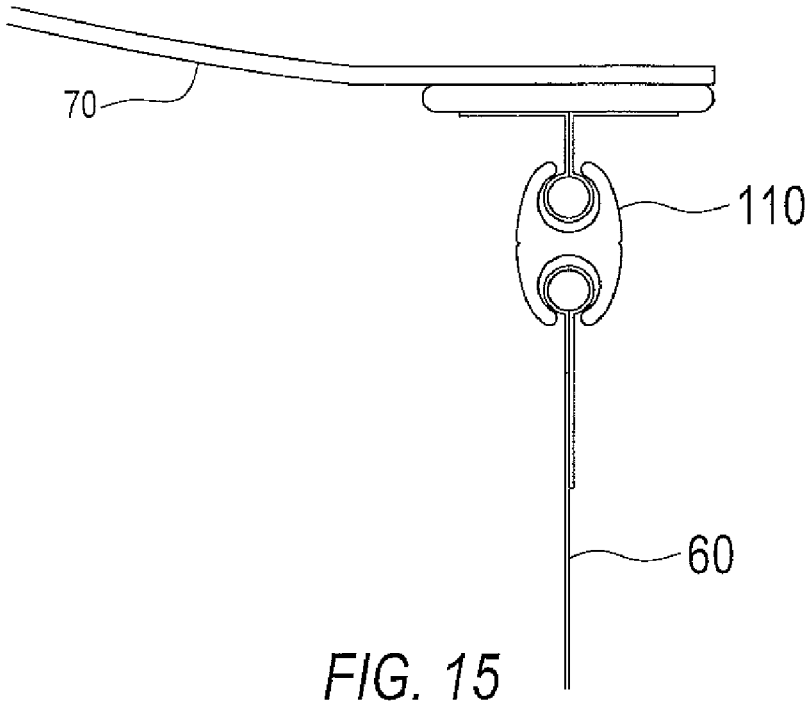
FIG. 15 is a sectional view of a tent canopy membrane and tent wall joined by a keder rail.
Figure 16:
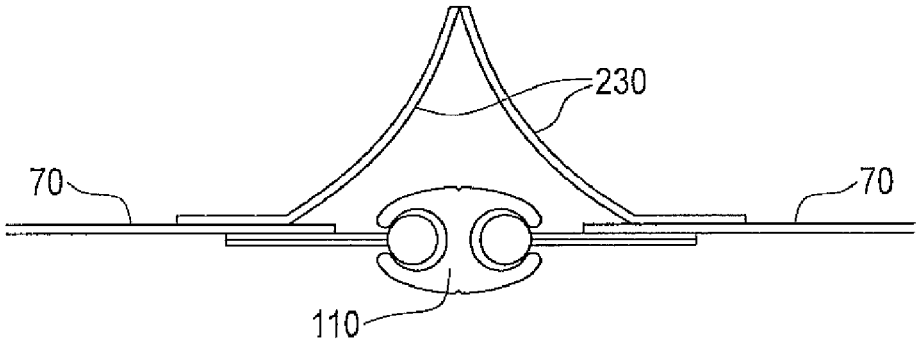
FIG. 16 is a sectional view of a keder rail field joint and cover flap seal.
Figure 17:
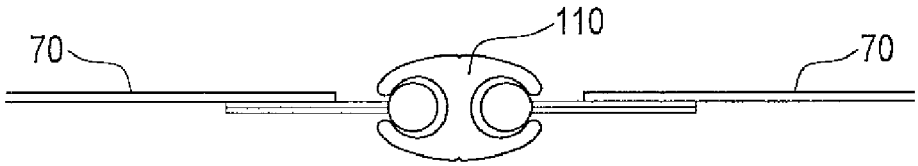
FIG. 17 is a sectional view of a keder rail field joint with no cover flaps.

Referring to FIG. 15, shows a keder rail 110 joining a module 70 of a tent canopy to a tent wall 60. FIG. 16 shows an alternate embodiment of a field joint 80, a novel keder rail 110 shown in cross-section, joining adjacent modules 70 of a tent canopy membrane. The field joint is sealed against precipitation by cover flaps 230. FIG. 17 shows a further alternate embodiment of a field joint 80, without cover flaps. The novel keder rail 110 is shown in cross-section, joining adjacent modules 70 of a tent canopy membrane.

Referring to FIGS. 13-17, the alternate embodiment of the keder rail 110 is shown having an optional groove 240 extending longitudinally down the length of the convex upper and lower surfaces. The grooves 240 are tiny superficial markings used as references if, for example, a user needs to center a drill bit for drilling the keder rail.

The steeper the angle the keder rail 110 experiences when the tent 10 is erected, the greater the degree of curvature of the convex surface 120 required to ensure that water runs to the sides of the keder rail 110.

Figure 11:
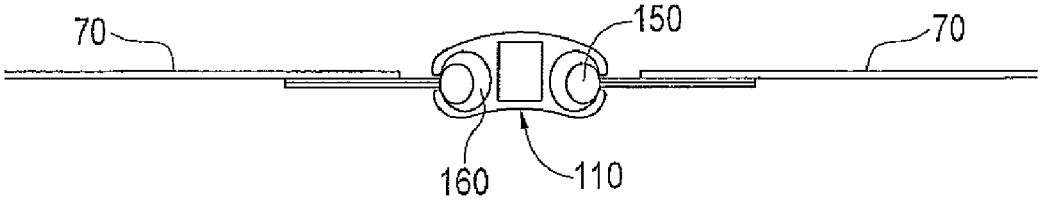
FIG. 11 is a sectional view of a keder rail field joint with no cover flaps.
Figure 12:
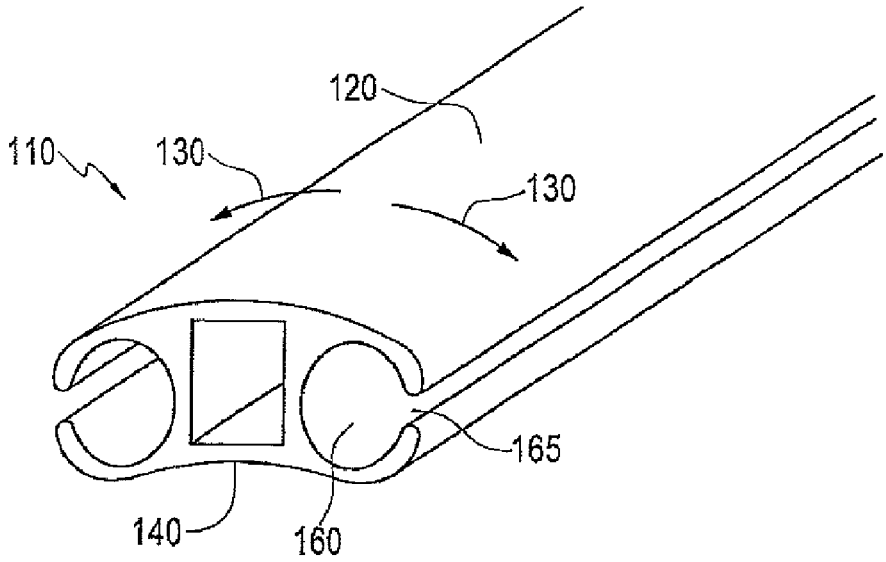
FIG. 12 is a perspective view of a keder rail.

Although the keder rail 110 is described herein the context of a tensile tent 10 structure having no beams, it will be readily apparent to persons skilled in the art that the novel keder rail of the present invention may itself take the form of a beam, post or other structural member. Such a structural member would exhibit the same water-shedding characteristics as the keder rail 110 of FIGS. 3 and 11.

Referring to FIGS. 3 and 10-13, the stiffness (or flexibility) required of the keder rail 110 will depend its specific intended application. For example, a keder rail forming part of the tent canopy of a tensile tent structure, such as that shown in FIGS. 1 and 2, likely requires some degree of longitudinal flexibility so that it can conform to the curvature of the canopy. However, regardless of longitudinal flexibility, all embodiments of the keder rail 110 require lateral stiffness sufficient to prevent the release of the keder strip 150 through the elongated opening 165 of the channel. In embodiments where the keder rail acts as a beam, post or similar structural member, the keder rail will also be required to have longitudinal rigidity in order to act as a weight or load bearing part of the larger structure.

In the preferred embodiment, the keder rail 110 of FIGS. 3 and 10-12 will be made of metal or plastic, however, it can be made of any appropriate material.

Referring to FIGS. 4-8, an alternative embodiment of the field joint 80 is shown, having a eyelet and lace joint between adjacent membrane modules 70. In the illustrative embodiment of FIGS. 4-8, the field joint 80 is made up of an eyelet side 210 and a lace side 220 on adjacent edges of adjacent modules 70. Each one of the eyelet and lace sides has a cover flap 230 extending from the upper side of the membrane module 70. When the eyelet side 210 and the lace side 220 are engaged, so that the membrane modules 70 are joined, the upper extremities of the cover flaps 230 come into contact. Engagement of the eyelet and lace sides 210, 220 causes the cover flaps 230 to press against one another in a "prayer" position, forming a seal therebetween. Rainwater is thereby prevented from reaching the engaged lace and eyelet sides 210, 220. Advantageously, the cover flaps can be made of heavy weight rigid fabric strips to maximize the pressure between the two strips. Employing a PVDF or Teflon finish on the inner surfaces of the cover flaps helps to guard against capillary action.

Figure 10:
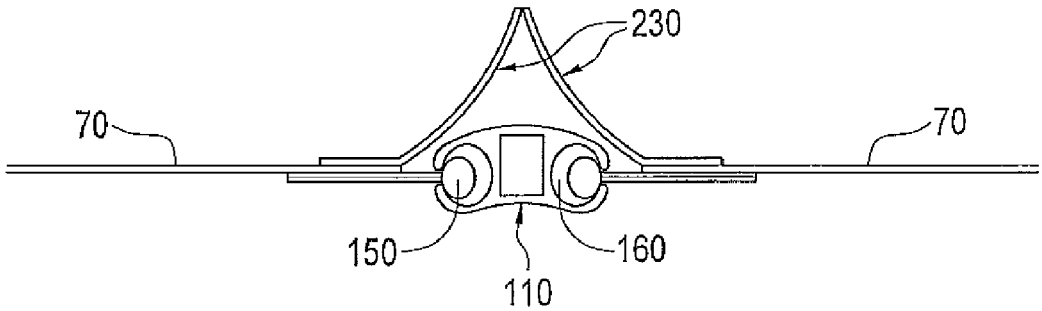
FIG. 10 is a sectional view of a keder rail field joint and cover flap seal.

For the sake of illustration, the modules 70 shown in FIGS. 4-8 are joined by an eyelet and lace mechanism, however, it will be readily apparent that any one of a number of different mechanisms may be used, such as zippers, Velcro, the novel keder rails 110 of the present invention, etc., (see, for example, FIG. 10).

Figure 9:
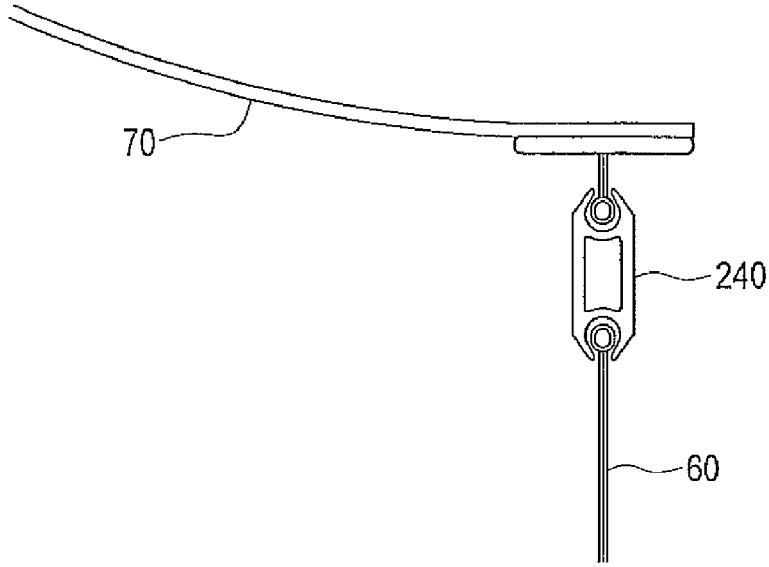
FIG. 9 is a sectional view of a side wall.

Referring to FIG. 9, a side wall 60 of the tent is shown coupled to a module 70 of the membrane 40 by a conventional keder extrusion 240. In the embodiment of FIG. 9, the water-shedding characteristics of the novel keder rail 110 (see FIGS. 3, 10 and 11) of the present invention are not required, therefore, a conventional keder extrusion 240 may be used.

Referring to FIGS. 2(*a-d*), 3-8 and 10, depending on the desired characteristics of the interface 80 between modules 70 of the membrane 40, the interface 80 can be achieved with or without the cover flaps 230, and using one or more of the following mechanisms, alone or in combination: the keder rail 110; and one or more prior art joining means such as eyelet and lace, zippers, Velcro, conventional keder extrusions, etc. In addition to the water-shedding characteristics, the keder rail 110 does not transmit shear forces between adjacent modules 70 and therefore does not result in wrinkles in the tent membrane 40, thereby improving the aesthetics of the tent 10. The kidder rail 110 is also easier to set-up than, for example, eyelet and lace because it is not as sensitive to accurate indexing.

The interfaces 80 described in FIGS. 3-8 can be used to join adjacent modules of a single tent membrane of, alternatively, multiple tents or tent membranes so as to expand to form larger tensile structures.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A joining device for joining a first membrane module of a tent or canopy to a second membrane module of the tent or canopy, wherein said first membrane module comprises a first membrane that has an edge and an upper surface, and wherein said second membrane module comprises a second membrane that has an edge and an upper surface, wherein said joining device comprises a joint that joins the edge of the first membrane to the edge of the second membrane, wherein said joint comprises:

a. a first keder strip adapted to be connected to the edge of the first membrane and to extend along the edge of the first membrane;

b. a second keder strip adapted to be connected to the edge of the second membrane and to extend along the edge of the second membrane;

c. a water-shedding keder rail, wherein said water-shedding keder rail comprises:

i) a first channel having a first elongated opening for receiving said first keder strip, wherein said first channel is substantially parallel to a longitudinal axis of said water-shedding keder rail;

ii) a second channel having a second elongated opening for receiving said second keder strip, wherein said second channel is substantially parallel to said first channel, whereby the first membrane module and the second membrane module are joined together when said first keder strip and said second keder strip are received by said first channel and said second channel, respectively;

iii) an upper surface facing upwards when the tent or canopy is assembled, wherein said upper surface extends from said first elongated opening to said second elongated opening, and wherein said upper surface is convex about the longitudinal axis, whereby water falling on said upper surface flows off of said keder rail; and, iv) a lower side opposite said upper surface;

d. a first cover flap adapted to extend from the upper surface of the first membrane; and, e. a second cover flap adapted to extend from the upper surface of the second membrane, wherein said second cover flap opposes said first cover flap, wherein tension created by joining the first membrane module to the second membrane module causes said first cover flap and said second cover flap to press together and slidably abut one another, wherein a seal is formed over said joint by the slidable abutment of said first cover flap and said second cover flap, whereby the seal shields said joint.

2. A joining device according to claim 1, wherein said keder strip is made of at least one of metal or plastic.

3. A tent or canopy comprising said joining device of claim 1, wherein said tent or canopy further comprises:

a. the first membrane module; and, b. the second membrane module;

wherein said first keder strip and said second keder strip are received within respective ones of said first channel and said second channel when said tent or canopy is assembled.

4. A tent or canopy according to claim 3, wherein said first membrane module and said second membrane module form a valley therebetween when said first membrane module and said second membrane module are joined by said joining device, and wherein said joint runs through the valley.

5. A joining device for joining a first membrane module of a tent or canopy to a second membrane module of the tent or canopy, wherein said first membrane module comprises a first membrane that has an edge and an upper surface, and wherein said second membrane module comprises a second membrane that has an edge and an upper surface, wherein said joining device comprises:

a. a first cover flap adapted to extend from the upper surface of the first membrane;

b. a second cover flap adapted to extend from the upper surface of the second membrane; and, c. a joint for joining the edge of the first membrane to the edge of the second membrane wherein said joint comprises:

i. a first keder strip adapted to be connected to the edge of the first membrane and to extend along the edge of the first membrane;

ii. a second keder strip adapted to be connected to the edge of the second membrane and to extend along the edge of the second membrane; and, iii. a water-shedding keder rail, wherein said keder rail comprises:

(a) a channel for receiving said first keder strip;

(b) a channel for receiving said second keder strip, wherein said first channel and said second channel are substantially parallel to a longitudinal axis of said water-shedding keder rail, and wherein the first membrane and the second membrane are joined when their respective keder strips are received by the respective channels;

(c) a first surface facing upwards when the tent or canopy is assembled, wherein said first surface is convex about the longitudinal axis, whereby water falling on said first surface flows off of said keder rail; and, (d) a second surface opposite said first surface, wherein tension created by joining the first membrane module to the second membrane module causes said first cover flap and said second cover flap to press together and slidably abut one another, whereby a seal is formed over said joint by the slidable abutment of said first cover flap and said second cover flap, wherein the seal shields said joint.

6. A tent or canopy comprising the joining device of claim 5, wherein said tent or canopy further comprises:

a. the first membrane module; and b. the second membrane module, wherein said first membrane module and said second membrane module are joined by said joining device.

7. A tent or canopy according to claim 6, wherein a valley is formed between said first membrane module and said second membrane module, and wherein said joint runs through the valley.

* * * * *